US008373607B2

(12) United States Patent
Chiang

(10) Patent No.: US 8,373,607 B2
(45) Date of Patent: Feb. 12, 2013

(54) TUNABLE ANTENNA STRUCTURE HAVING A VARIABLE CAPACITOR

(75) Inventor: Chi-Ming Chiang, Bade (TW)

(73) Assignee: Auden Techno Corp., Taoyuan County (TW)

( * ) Notice: Subject to any disclaimer, the term of this patent is extended or adjusted under 35 U.S.C. 154(b) by 371 days.

(21) Appl. No.: 12/856,070

(22) Filed: Aug. 13, 2010

(65) Prior Publication Data

US 2012/0038528 A1 Feb. 16, 2012

(51) Int. Cl.
*H01Q 9/04* (2006.01)
*H01Q 1/38* (2006.01)

(52) U.S. Cl. ..... 343/745; 343/700 MS; 343/860

(58) Field of Classification Search ..... 343/745, 343/860, 846, 702, 828, 829, 831, 700 MS
See application file for complete search history.

(56) References Cited

U.S. PATENT DOCUMENTS

2008/0122712 A1* 5/2008 Chen ..... 343/745
2010/0231472 A1* 9/2010 Tran ..... 343/742
2011/0032170 A1* 2/2011 Chiang et al. ..... 343/860

* cited by examiner

*Primary Examiner* — Daniel D Chang
(74) *Attorney, Agent, or Firm* — Houtteman Law LLC

(57) ABSTRACT

A tunable antenna structure having a variable capacitor includes a substrate, a first metal strip, a second metal strip and a third metal strip formed on the substrate, a variable capacitor element located between the first metal strip and the second metal strip, an inductor element located between the second metal strip and the third metal strip, a first capacitor element located between the first metal strip and the third metal strip, and a second capacitor element located on the third metal strip.

10 Claims, 3 Drawing Sheets

TUNABLE ANTENNA STRUCTURE HAVING A VARIABLE CAPACITOR

BACKGROUND OF THE INVENTION

1. Field of the Invention

The present invention relates to a tunable antenna structure. In particular, the present invention relates to a tunable antenna structure that uses a variable capacitor to adjust the operation frequency.

2. Description of Related Art

The GSM standard is the most mature and widely adapted wireless communication standard today. According to the statistics from the GSM association, GSM technology occupies ⅓ of the worldwide wireless communication market currently and still increasing. In addition to voice communication, GSM also provides data communication solutions for middle and low speed data transfer, for example, GPRS/EDGE, Evolved EDGE, etc, to meet the band width requirement for such data transmission. The GSM standard emphasizes on the development of software technology rather than relying on the renewal of network hardware devices.

In order to meet the requirement of an increased data transmission rate, such as video-audio data sharing and instant video communication, the 3 G wireless communication technology has been developed. Currently, 3 G technology includes the European UMTS technology standard (such as WCDMA and TD-CDMA) and the American CDMA2000 technology standard. With the maturity of the HSDPA, HSPA, HSPA+Rel.8 protocols, the UMTS standard originally developed form GPRS and EDGE has further evolved into the 3.9 G long term evolution (LTE) standard. As 4 G becomes widely adapted, the quantity of the UMTS/HSPA data package has greatly surpassed the quantity of the traditional voice package, and is still growing at a rate four times of the increasing rate of the voice package. Moreover, the LTE enables high bandwidth download rate at 100 Mbps and upload rate at 50 Mbps, and has improved spectral efficiency. Thus, LTE could be a promising solution for meeting the high data transmission rate requirements and improving the transmission delay problems.

However, in order to miniaturize the dimension of LTE antenna, the substrate with small dimension is adopted. The problem of the band width for low frequency of antenna is inadequate. The operation frequency cannot be fully covered.

SUMMARY OF THE INVENTION

One particular aspect of the present invention is to provide a tunable antenna structure having a variable capacitor. By changing the capacitance of the variable capacitor element, the operation frequency of the antenna is adjusted to improve the antenna characteristic for the low frequency.

The tunable antenna structure having a variable capacitor includes a substrate, a first metal strip, a second metal strip and a third metal strip formed on the substrate, a variable capacitor element located between the first metal strip and the second metal strip, an inductor element located between the second metal strip and the third metal strip, a first capacitor element located between the first metal strip and the third metal strip, and a second capacitor element located on the third metal strip.

In one embodiment, the capacitance value of the variable capacitor element is adjusted to 3.9 pF and 39 pF. By using the different resistances formed from the different capacitance values, the antenna can receives the signal of low frequencies, between 824 and 960 MHz, and between 704 and 787 MHz.

The present invention has the following characteristics. By adjusting the capacitance value of the variable capacitor element, the receiving frequency of the tunable antenna structure for low frequencies is controlled. Therefore, the antenna can receive the signal for low frequencies, and the dimension of the antenna can be reduced.

For further understanding of the present invention, reference is made to the following detailed description illustrating the embodiments and examples of the present invention. The description is for illustrative purpose only and is not intended to limit the scope of the claim.

DETAILED DESCRIPTION OF THE PREFERRED EMBODIMENTS

The present invention provides a tunable antenna structure that uses a variable capacitor element located on the substrate to adjust the operation frequency of the antenna. The tunable antenna structure can improve the antenna characteristic for low frequencies. Also, the tunable antenna structure can be applied to antenna structures of small dimension.

Figure 1A:
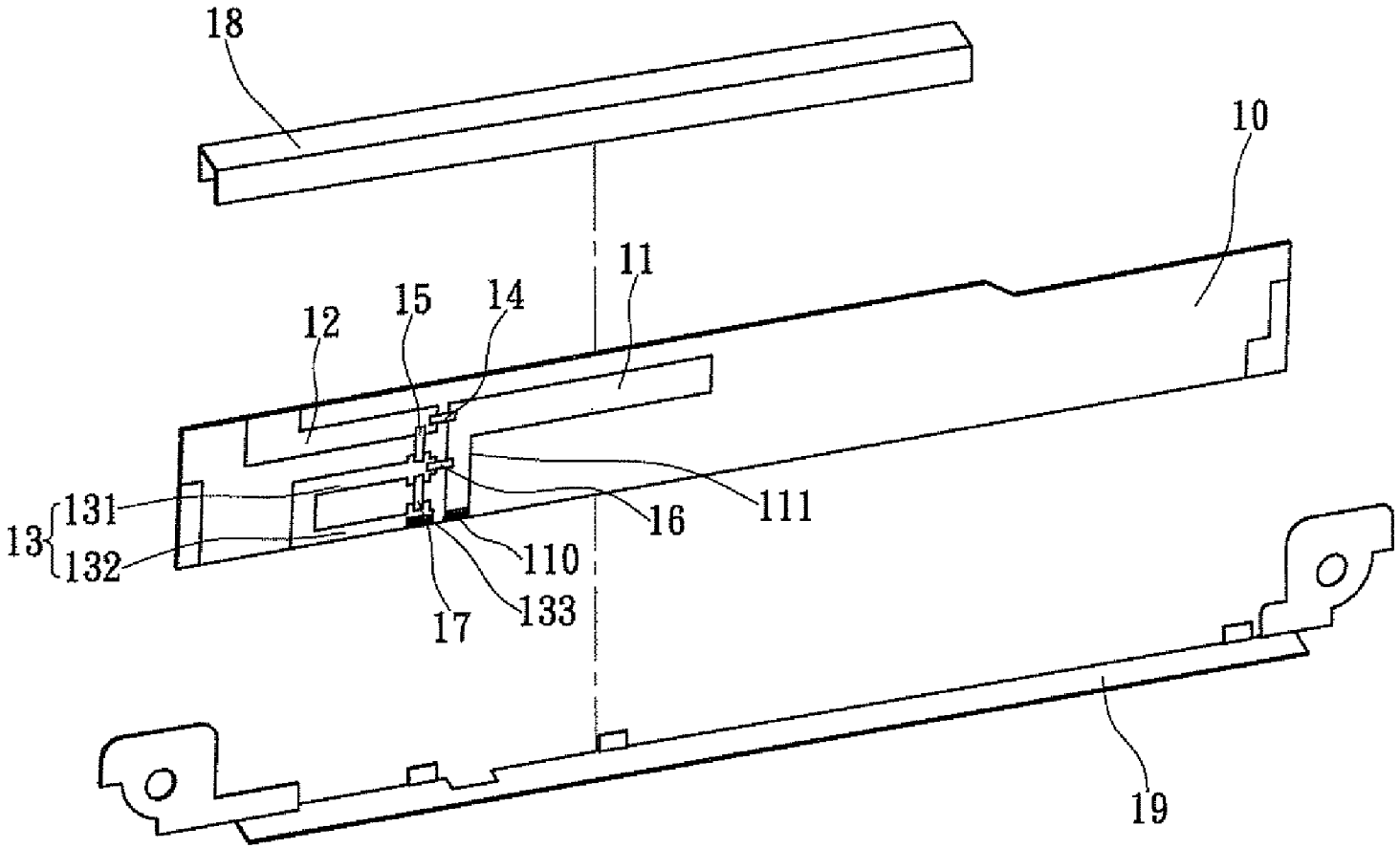
FIG. 1A is an exploded perspective view of the tunable antenna structure having a variable capacitor of the present invention.
Figure 1B:
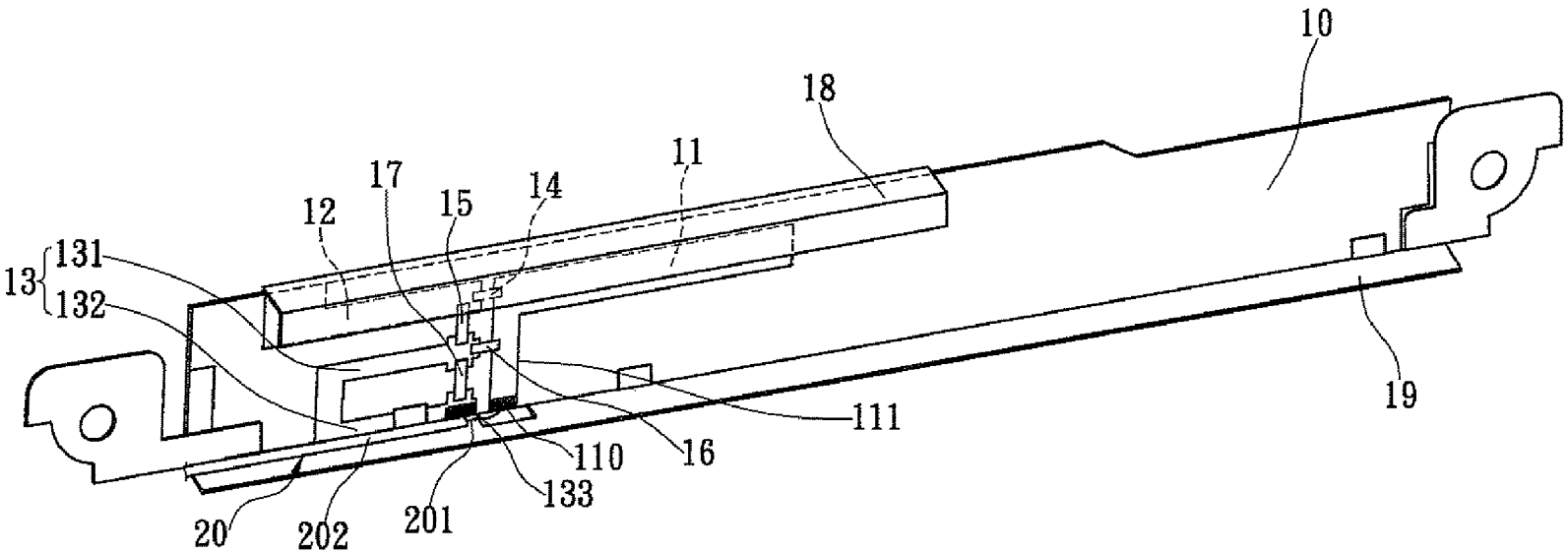
FIG. 1B is a perspective view of the tunable antenna structure having a variable capacitor of the present invention.

Reference is made to FIGS. 1A and 1B. The tunable antenna structure having a variable capacitor comprises a substrate 10, a first metal strip 11, a second metal strip 12, a third metal strip 13, a variable capacitor element 14, an inductor element 15, a first capacitor element 16, and a second capacitor element 17.

In the instant embodiment, the first metal strip 11, the second metal strip 12, the third metal strip 13, the variable capacitor element 14, the inductor element 15, the first capacitor element 16 and the second capacitor element 17 are located on the same surface of the substrate 10.

In this embodiment, the first metal strip 11 is L-shaped. The second metal strip 12 and the third metal strip 13 correspond to the short side 111 of the L-shaped first metal strip 11. The variable capacitor element 14 is located between the first metal strip 11 and the second metal strip 12. One end of the second metal strip 12 is located at an edge of the substrate 10 to electrically connect a radiating metal part 18. The other end of the second metal strip 12 extends toward the short side 111 of the L-shaped first metal strip 11, and the variable capacitor element 14 is disposed between the second metal strip 12 and the short side 111 of the L-shaped first metal strip 11. By changing the capacitance value of the variable capacitor element 14, the operation frequency of the antenna is adjusted and the antenna characteristic is improved. In this embodiment, the variable capacitor element 14 is a capacitance-variable diode of which the capacitance value can be changed by changing the applied voltage. For example, in the instant embodiment, a specific voltage range is applied to maintain the capacitance value of the variable capacitor element 14 between 3.9 pF and 39 pF. However, the effective voltage range is not limit by the instant example. Furthermore, a signal/voltage input point 110 is located at the end of the short side 111 of the L-shaped first metal strip 11 and is electrically connected to a center conducting body 201 of a coaxial cable 20.

The inductor element 15 is located between the second metal strip 12 and the third metal strip 13. The first capacitor element 16 is located between the first metal strip 11 and the third metal strip 13. The second capacitor 17 is located on the third metal strip 13. In the instant embodiment, the third metal strip 13 is U-shaped with the opening facing the short side of the first metal strip, and has a first end 131 and a second end 132. Furthermore, the inductor element 15 is located between the first end 131 of the third metal strip 13 and the second metal strip 12. The first capacitor element 16 is located between the first end 131 of the third metal strip 13 and the short side 111 of the L-shaped first metal strip 11. The second capacitor element 17 is located between the first end 131 of the third metal strip 13 and the second end 132 of the third metal strip 13. The second end 132 of the third metal strip 13 has a grounding point 133, and is welded to a grounding metal part 19 and the outer conducting layer 202 of a coaxial cable 20.

Therefore, the instant disclosed antenna structure utilizes micro metal strip (the first metal strip 11, the second metal strip 12, and the third metal strip 13) and LC elements (the variable capacitor element 14, the inductor element 15, the first capacitor element 16 and the second capacitor element 17) to form separate paths for the antenna signals and voltage. Moreover, by adjusting the applied voltage to change the capacitance value of the variable capacitor element 14, the performance of the antenna is enhanced.

The following embodiment illustrates the effect of the present invention. In one embodiment, the capacitance value of the variable capacitor element 14 is set to 3.9 pF or 39 pF. The inductance value of the inductor element 15 is 270 nH. The capacitance value of the first capacitor element 16 is 100 pF. The capacitance value of the second capacitor element 17 is 0.8 pF. Thus, when a voltage is applied, a DC current passes through the variable capacitor element 14 (the first capacitor element 16 is used for separating DC voltage) via the signal/voltage input point 110 then passes through the inductor element 15 (the inductor element 15 can be treated as a bias-voltage circuit loop of the variable capacitor element 14), thus form a complete circuit loop with the grounding point 133 of the third metal strip 13. For the antenna signal, the first capacitor element 16 can be treated as a short circuit. The variable capacitor element 14 is used to adjust the operation frequency of the antenna. The inductor element 15 is an open circuit. The second capacitor element 17 is used to adjust the high frequency impedance of the antenna to increase bandwidth, while the capacitance value of the variable capacitor element 14 is used for adjusting the operation frequency of low frequency of the antenna.

Figure 2A:
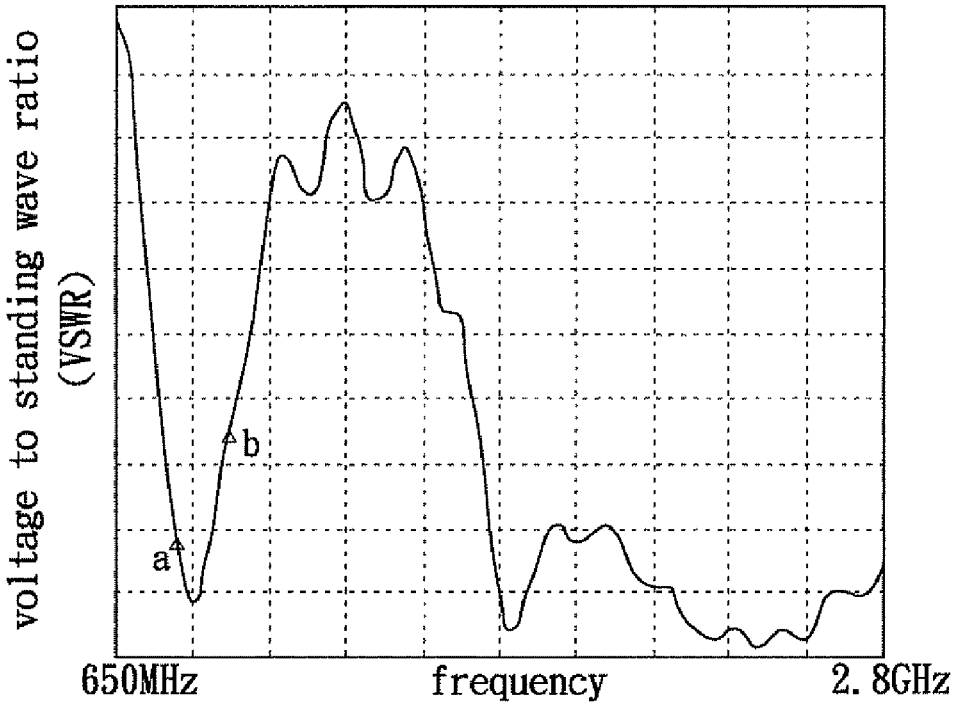
FIG. 2A is a characteristic diagram of the antenna when the variable capacitor element is 3.9 pF of the present invention.
Figure 2B:
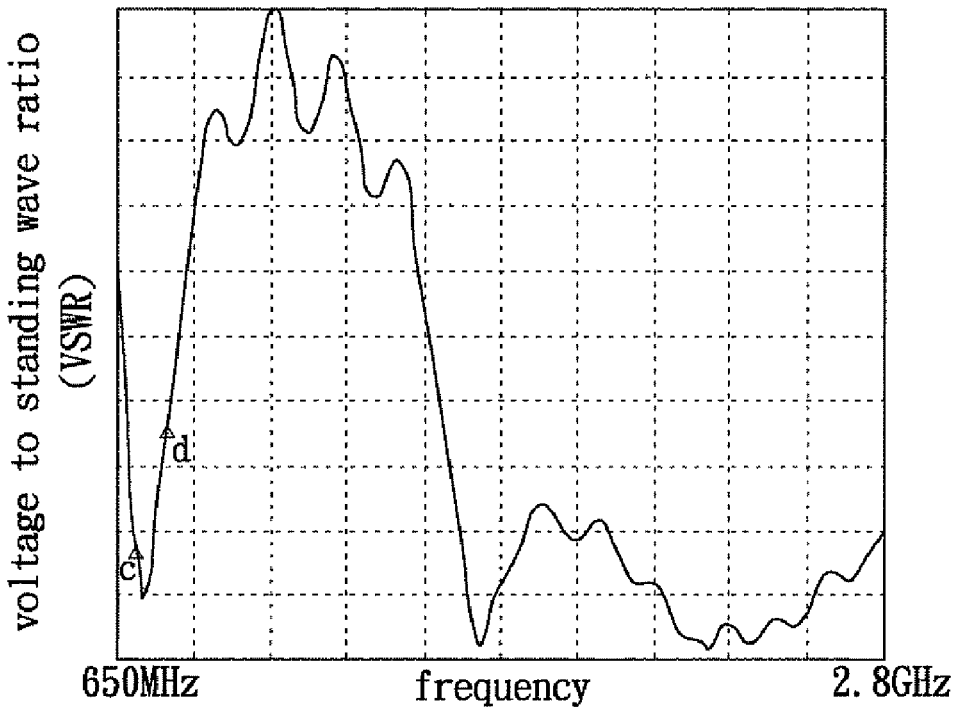
FIG. 2B is a characteristic diagram of the antenna when the variable capacitor element is 39 pF of the present invention.

Reference is made to FIGS. 2A and 2B. FIG. 2A shows the antenna characteristic of the tunable antenna structure. The capacitance value of the variable capacitor element 14 is adjusted to 3.9 pF. According to locations a and b, the frequency range of the tunable antenna structure for low frequency is between 824 and 960 MHz under the capacitance value of the variable capacitor element 14 is 3.9 pF. FIG. 2B shows the antenna characteristic of the tunable antenna structure. The capacitance value of the variable capacitor element 14 is adjusted to 39 pF. According to locations c and d, the frequency range of the tunable antenna structure for low frequency is between 704 and 787 MHz under the capacitance value of the variable capacitor element 14 is 39 pF. Therefore, by adjusting the capacitance value of the variable capacitor element 14, the receiving frequency range of the tunable antenna structure for low frequency is controlled.

Furthermore, when the dimension of the antenna is reduced, the bandwidth of the antenna is also reduced so that the operation frequency cannot be fully covered. Therefore, the present invention adjusting the capacitance value of the variable capacitor element 14 to control the receiving frequency range of the tunable antenna structure for low frequency. The present invention can be applied to an antenna with a small dimension. In this embodiment, the width of the substrate 10 is 8 mm, and the dimension of the antenna is reduced by 20% when it is compared with a traditional antenna.

Reference is made to tables 1 and 2, which show the antenna characteristic of the low frequency of the tunable antenna structure (the capacitance value of the variable capacitor element 14 is adjusted to 3.9 pF and 39 pF). According to the results, the 3D gain and the efficiency of the antenna under low frequency can meet the specification of products. Please note "F" represents frequency (MHz), "G" represents 3D GAIN, "E" represents efficiency (%).

TABLE 1

(capacitance value of the variable capacitor element 14 is adjusted to 39 pF)

| | | | | | | | | | | | |
|---|---|---|---|---|---|---|---|---|---|---|---|
| F | 704 | 710 | 716 | 734 | 740 | 746 | 751 | 756 | 777 | 782 | 787 |
| G | −5.26 | −4.91 | −4.56 | −4.09 | −4.09 | −3.85 | −4.03 | −3.93 | −4.61 | −4.92 | −5.22 |
| E | 29.76 | 32.27 | 34.92 | 38.96 | 38.92 | 41.17 | 39.50 | 40.45 | 34.54 | 32.16 | 30.04 |

TABLE 2

(capacitance value of the variable capacitor element 14 is adjusted to 3.9 pF)

| | | | | | | | | | | |
|---|---|---|---|---|---|---|---|---|---|---|
| F | 824 | 830 | 835 | 836 | 840 | 849 | 860 | 865 | 869 | 870 |
| G | −3.89 | −3.92 | −3.85 | −3.87 | −3.94 | −4.09 | −4.10 | −3.84 | −3.90 | −3.90 |
| E | 40.83 | 40.49 | 41.20 | 40.97 | 40.33 | 38.92 | 38085 | 41.30 | 40.68 | 40.71 |
| F | 875 | 880 | 885 | 894 | 900 | 915 | 920 | 925 | 940 | 960 |
| G | −3.67 | −3.83 | −3.85 | −4.21 | −4.34 | −4.74 | −4.88 | −4.94 | −5.54 | −6.77 |
| E | 42.93 | 41.38 | 41.18 | 37.85 | 36.79 | 33.50 | 32.51 | 32.05 | 27.87 | 21.03 |

Table 3 shows the antenna characteristic of the tunable antenna structure. According to the results, the 3D gain and the efficiency of the antenna under high frequency can meet the specification of products

TABLE 3

| | | | | | | | | | | |
|---|---|---|---|---|---|---|---|---|---|---|
| F | 1710 | 1750 | 1785 | 1805 | 1840 | 1850 | 1880 | 1910 | 1920 | 1930 |
| G | −3.51 | −2.62 | −2.71 | −3.01 | −3.70 | −4.31 | −5.12 | −4.79 | −4.55 | −4.08 |
| E | 44.49 | 54.64 | 53.53 | 49.93 | 42.65 | 37.05 | 30.75 | 33.15 | 35.01 | 39.06 |
| F | 1950 | 1960 | 1980 | 1990 | 2110 | 2140 | 2170 | 2300 | 2350 | 2400 |
| G | −3.91 | −4.00 | −4.27 | −3.92 | −3.20 | −3.40 | −3.53 | −2.19 | −3.70 | −2.19 |
| E | 40.63 | 39.79 | 37.35 | 40.49 | 47.83 | 45.70 | 44.27 | 60.33 | 42.58 | 60.38 |
| F | 2500 | 2535 | 2570 | 2620 | 2655 | 2690 | | | | |
| G | −1.65 | −1.55 | −1.43 | −2.54 | −3.04 | −2.90 | | | | |
| E | 68.39 | 69.97 | 71.86 | 55.65 | 49.59 | 51.22 | | | | |

The present invention has the following characteristics.

1. The tunable antenna structure utilizes the characteristic of the variable capacitor element to adjust the operation frequency of the antenna to enhance the performance of the antenna.

2. The tunable antenna structure can be applied to an antenna with a small dimension. It utilizes the capacitance value of the variable capacitor element to adjust the operation frequency of the antenna. Thereby, the antenna with a small dimension also can receive the signal of low frequency. The antenna can be miniaturized.

The description above only illustrates specific embodiments and examples of the present invention. The present invention should therefore cover various modifications and variations made to the herein-described structure and operations of the present invention, provided they fall within the scope of the present invention as defined in the following appended claims.

What is claimed is:

1. A tunable antenna structure having a variable capacitor, comprising:

a substrate;

a first metal strip, a second metal strip and a third metal strip formed on the substrate;

the variable capacitor located between the first metal strip and the second metal strip;

an inductor element located between the second metal strip and the third metal strip;

a first capacitor element located between the first metal strip and the third metal strip; and a second capacitor element located on the third metal strip for adjusting the high frequency impedance of the tunable antenna structure.

2. The tunable antenna structure having a variable capacitor as claimed in claim 1, further comprising a radiating metal part and a grounding metal part, wherein the radiating metal part is electrically connected with one end of the second metal strip, and the grounding metal part is electrically connected with a grounding point of the third metal strip.

3. The tunable antenna structure having a variable capacitor as claimed in claim 2, wherein the first metal strip is L-shaped, and the second metal strip and the third metal strip correspond to a short side of the L-shaped first metal strip.

4. The tunable antenna structure having a variable capacitor as claimed in claim 3, wherein the variable capacitor is located between another end of second metal strip and the short side of the L-shaped first metal strip.

5. The tunable antenna structure having a variable capacitor as claimed in claim 4, wherein the variable capacitor is a capacitance-variable diode, the capacitance value is adjusted by the applied voltage, and the capacitance value of the variable capacitor element is adjusted within a specific range.

6. The tunable antenna structure having a variable capacitor as claimed in claim 5, wherein the capacitance value of the variable capacitor is changed between 3.9 pF and 39 pF.

7. The tunable antenna structure having a variable capacitor as claimed in claim 4, wherein the third metal strip is U-shaped, and has a first end and a second end.

8. The tunable antenna structure having a variable capacitor as claimed in claim 7, wherein the inductor element is located between the first end of the third metal strip and the second metal strip, and the first capacitor element is located between the first end of the third metal strip and the short side of the L-shaped first metal strip.

9. The tunable antenna structure having a variable capacitor as claimed in claim 8, wherein the second capacitor element is located between the first end of the third metal strip and the second end of the third metal strip, and the grounding point is located on the second end of the third metal strip.

10. The tunable antenna structure having a variable capacitor as claimed in claim 9, wherein the short side of the L-shaped first metal strip has a signal/voltage input point, and is connected with a center conduct body of an coaxial cable.

* * * * *